US006602546B1

(12) United States Patent
Kohler

(10) Patent No.: US 6,602,546 B1
(45) Date of Patent: Aug. 5, 2003

(54) METHOD FOR PRODUCING CORRUGATED CARDBOARD

(75) Inventor: Herbert B. Kohler, Uniontown, OH (US)

(73) Assignee: Coater Services, Inc., Uniontown, OH (US)

( * ) Notice: Subject to any disclaimer, the term of this patent is extended or adjusted under 35 U.S.C. 154(b) by 0 days.

(21) Appl. No.: 10/176,890

(22) Filed: Jun. 21, 2002

(51) Int. Cl.[7] ..... B05D 5/10
(52) U.S. Cl. ..... 427/207.1; 427/428
(58) Field of Search ..... 427/207.1, 428

(56) References Cited

U.S. PATENT DOCUMENTS

| | | | |
|---|---|---|---|
| 1,981,338 | A | 11/1934 | Swift, Jr. |
| 2,622,558 | A | 12/1952 | Mikkelsen |
| 3,026,231 | A | 3/1962 | Chavannes |
| 3,046,935 | A | 7/1962 | Wilson |
| 3,300,359 | A | 1/1967 | Nikkel |
| 3,306,805 | A | 2/1967 | Klein et al. |
| 3,560,310 | A | 2/1971 | Bolton |
| 4,177,102 | A | 12/1979 | Tokuno |
| 4,267,008 | A | 5/1981 | Owens |
| 4,306,932 | A | 12/1981 | Bradatsch et al. |
| 4,316,428 | A | 2/1982 | Flaum et al. |
| 4,316,755 | A | 2/1982 | Flaum et al. |
| 4,338,154 | A | 7/1982 | Berthelot et al. |
| 4,344,379 | A | 8/1982 | Roberts |
| 4,351,264 | A | 9/1982 | Flaum et al. |
| 4,589,944 | A | 5/1986 | Torti et al. |
| 4,603,654 | A | 8/1986 | Mori et al. |
| 4,757,782 | A | 7/1988 | Pullinen |
| 4,764,236 | A | 8/1988 | Nikkel |
| 4,886,563 | A | 12/1989 | Bennett et al. |
| 4,935,082 | A | 6/1990 | Bennett et al. |
| 5,037,665 | A | 8/1991 | LaMantia et al. |
| 5,048,453 | A | 9/1991 | Eriksson |
| 5,103,732 | A | 4/1992 | Wells et al. |
| 5,275,657 | A | 1/1994 | Duffy et al. |
| 6,068,701 | A | 5/2000 | Kohler et al. |

FOREIGN PATENT DOCUMENTS

| | | |
|---|---|---|
| CA | 1072873 | 3/1980 |
| EP | 0037332 | 10/1981 |

OTHER PUBLICATIONS

E. Daub et al., Gluing Corrugating Medium and Linerboard Together on the Corrugator, pp. 171–178, Tappi Journal, Jun. 1990.

*Primary Examiner*—Bernard Pianalto
(74) *Attorney, Agent, or Firm*—Pearne & Gordon LLP

(57) ABSTRACT

A method is provided for applying adhesive to the flutes of a corrugated sheet to bond a face surface thereto. An applicator roll is provided with a uniform thin coating of adhesive by a metering rod urged toward the surface of the applicator roll. A rider roll is provided adjacent the applicator roll and at the same height to form a vertical space for passage of the corrugated sheet therebetween so that the amount of glue applied to the crests of the flutes is proportional to the speed of the applicator roll. The space between the applicator roll and the rider roll is precisely controlled to control the degree of compression of the flutes during the application of the adhesive thereto. The flutes are preferably compressed 3–30, preferably 5–15, percent of their initial height to prevent application of adhesive to the rear sloping faces of the flutes. The applicator roll has a surface linear velocity substantially less than the speed of the corrugated sheet to accurately control the amount and placement of adhesive applied to the flutes.

36 Claims, 6 Drawing Sheets

METHOD FOR PRODUCING CORRUGATED CARDBOARD

BACKGROUND OF THE INVENTION

The present invention generally relates to the production of corrugated cardboard, and more particularly, to a novel and improved method for accurately applying an adhesive to the flutes of corrugated board centered on the flute crests, so that the flutes can be bonded to a face.

Typically, corrugated cardboard is formed by producing a corrugated sheet which is initially bonded along one side to a single face. Adhesive is then applied to the crests of the flutes remote from the single face by an applicator roll of a glue machine. Thereafter, a second face is applied to the adhesive on the flutes to produce a composite structure in which corrugations extend between and are bonded to spaced-apart faces.

In some instances, multiple-layer cardboard is produced in which more than one corrugated sheet is adhesively attached to additional faces so that, for example, a central flat face is bonded to a corrugated sheet on each side thereof, and outer flat faces are bonded to the sides of the two corrugated sheets remote from the central face.

The corrugated sheet is typically passed between a rider roll and an applicator roll to apply the adhesive to the flutes. The rider roll typically applies sufficient downward pressure to force the flute tips into contact with the applicator roll. This downward pressure causes compression or deformation of the flutes. The flutes enter the adhesive layer prior to being crushed against the applicator and often become overly wetted or saturated with adhesive due to the long dwell time. As a result, the flutes do not return to their original shape after being crushed. This permanent deformation of the flutes reduces the strength of the final cardboard.

It has been known in the art that glue machines can be run with the applicator roll operating at a lower speed than the web speed (speed at which the corrugated sheet passes between the applicator roll and the rider roll) in order to adjust glue weight. Unfortunately, as the applicator roll speed falls below about 98% that of the web speed, the difference in the relative speeds begins to pull or drag adhesive from the flute crests onto the trailing sloped face of the flutes. The result is that adhesive ends up being applied nonuniformly to the flutes, and that the face surfaces of a finished corrugated product are not smooth due to washboarding (i.e. face surface being pulled and adhered into the valleys of the corrugated sheet). The finished corrugated cardboard product is thus weaker due to weak bond strength between the corrugated sheet and the adhered-to face sheet. The finished cardboard also experiences directional differences in strength. Therefore, it has been impractical to adjust glue weight by lowering the applicator roll speed much below the web speed, and applicator roll speeds of at least 98% web speed have become the industry standard.

The adhesive applied to the flutes is also asymmetrical because the flutes plow through the adhesive layer on the applicator and are wetted on one sloped face more than the other. This asymmetrical application of the adhesive results in a lower bond strength for a given weight of adhesive and a rough surface finish on the face sheet due to warpage after the adhesive cures. Additionally, a relatively large amount of over spray is created which further increases the amount of glue used by the process.

Accordingly, there is a need in the art for an improved method for producing corrugated cardboard which obtains maximum strength in the finished product and an improved surface finish on the face. Furthermore, it is desirable to apply substantially less adhesive per unit area of the finished product and to produce the improved cardboard at an increased rate of production. It is particularly desirable to provide a method of applying adhesive accurately and sparingly to the centers or crests of the corrugated flutes without significant adhesive being applied to either the leading or trailing sloped faces of the flutes. Most preferably, such a method will allow glue weight adjustment by operating the applicator roll substantially below the web speed, preferably less than 95% the web speed, while still providing the adhesive only to the flute crests.

BRIEF SUMMARY OF THE INVENTION

The present invention provides a method and apparatus for uniformly and accurately applying adhesive to the crests of the flutes of corrugated sheets with little or no (or substantially no) adhesive being applied to either the leading or trailing sloped faces of the flutes. In accordance with the present invention, higher line speeds can be achieved, tighter performance specifications exceeding the capability of the industries standard machines are possible, and a significant reduction in the amount of glue used is achieved. In addition, accurately centering the adhesive onto the crests of the flutes provides stronger bond strength between the corrugated sheet and the adhered-to face sheet. Directional differences in strength are minimized or substantially eliminated, and surface smoothness of the face sheets is improved (washboarding reduced). Because the adhesive is very accurately deposited only to the flute crests, it is possible to reduce the adhesive weight deposition rate about 10–70% of that required in conventional machines while delivering the same or comparable bond and crush strength. Additionally, because there is no practical lower limit to the controlled glue weight, cold set adhesives can be used to further improve board properties and reduce energy costs and warpage losses. Furthermore, in accordance with the present invention, smoother and more printable boards with greatly reduced warpage and improved surface finish are produced.

A preferred method according to the present invention includes the steps of rotating an applicator roll having an adhesive layer on the surface thereof on a rotational axis, and rotating a rider roll on a rotational axis substantially parallel, and located at a height substantially equal, to that of the rotational axis of the applicator roll. The corrugated sheet travels along a vertical path between the applicator roll and the rider roll, engaging the crests with the adhesive layer on the applicator roll to apply adhesive to the crests. The flutes are compressed against the applicator roll by the rider roll to achieve a height compression of 3–30% of the initial flute height as the adhesive is applied (i.e. the flutes are compressed down to 70–97% of their initial flute height) Most preferably, the flutes are compressed 5–15%, i.e. down to 85–95% of their initial flute height.

According to a further aspect of the invention, the method includes the steps of providing the layer of adhesive on the applicator roll, and moving the corrugated sheet through a space between the applicator roll and the rider roll for engaging the flutes with the adhesive layer on the applicator roll to apply adhesive to the flutes. The corrugated sheet travels past the applicator roll at a first speed and the applicator roll is rotated at second speed, such that a surface linear velocity of the applicator roll is less than 95% of the first speed, preferably less than 50% of the first speed, preferably less than 45% of the first speed, most preferably less than 40% of the first speed.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

As used herein, the terms 'glue' and 'adhesive' are used interchangeably, and refer to the adhesive that is applied to the flute crests of a corrugated sheet 18 according to the invention as hereinafter described. Also as used herein, the term 'web' refers to the corrugated sheet 18 traveling through a glue machine 38, and particularly as it travels past an applicator roll 48 for applying adhesive thereto as will be further described. In the description that follows, and from the drawings, it will be apparent that the web speed is controlled, at least in part, by the rotational speed of the rider roll 52.

Figure 1:
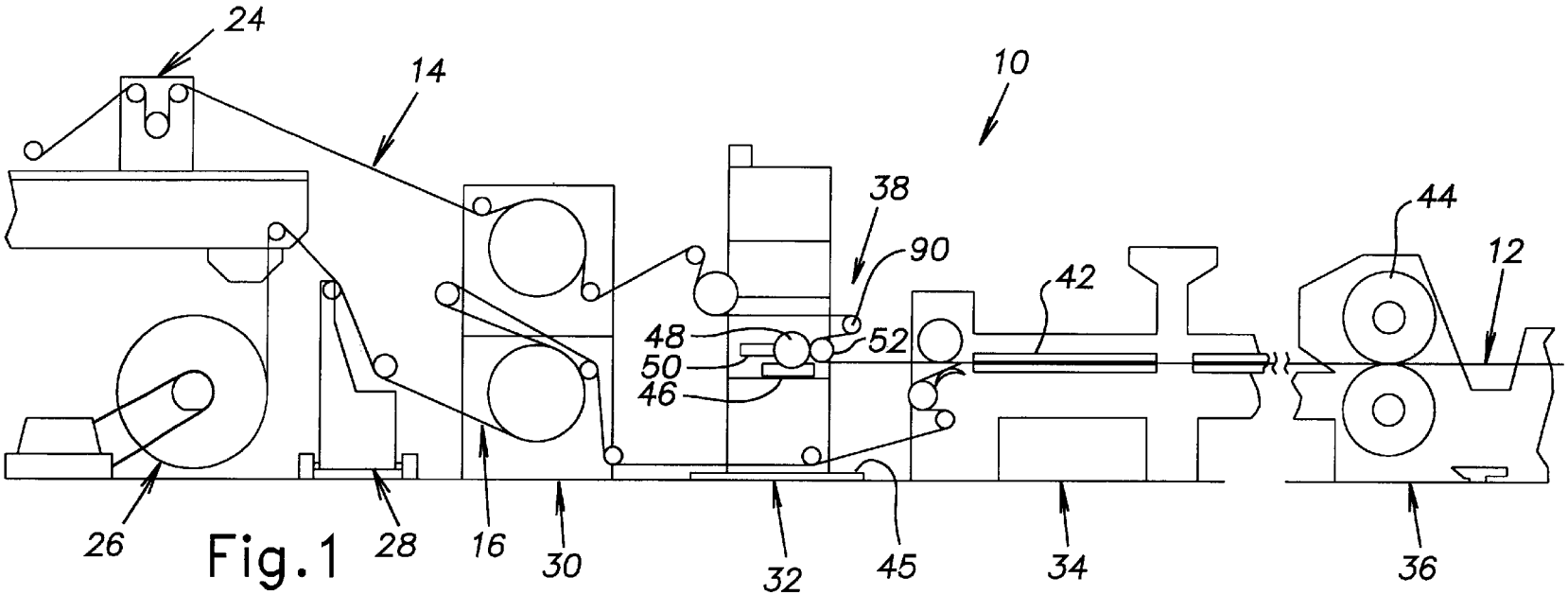
FIG. 1 is a schematic elevational view of a machine for producing cardboard in accordance with the present invention.
Figure 2C:
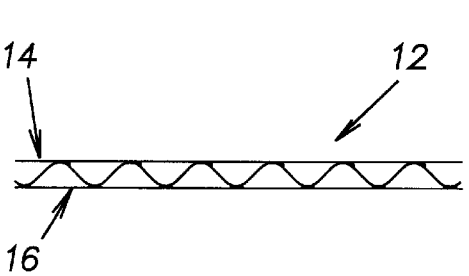
FIG. 2C is an elevational view of the single face corrugated sheet of FIG. 2A with a second face secured thereto.
Figure 2B:
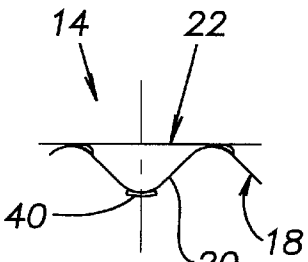
FIG. 2B is an enlarged elevational view of the single face corrugated sheet of FIG. 2A with adhesive applied to the crests of the flutes.
Figure 2A:
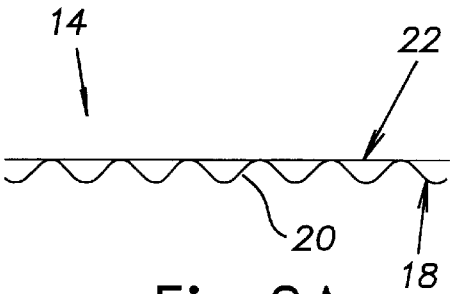
FIG. 2A is an enlarged elevation view of a single face corrugated sheet.

FIG. 1 schematically illustrates a machine 10 for producing single-corrugated cardboard sheet 12. As best shown in FIGS. 2A, 2B, and 2C, the single-corrugated cardboard sheet 12 is produced by joining a web of single-face corrugation assembly 14 with a face sheet 16. The single-face corrugation assembly 14 includes a corrugated sheet 18 having a plurality of flutes 20 and a first face sheet 22 bonded to the crests or tips of the flutes 20 on a first side of the corrugated sheet 18. The crests or tips of the flutes 20 on the second side of the corrugated sheet 18, remote from the attached first face sheet 22, are exposed.

It should be understood that the illustrated machine 10 is shown only by way of example and that the present invention can be applied to many different types of machines. For example, the present invention can be easily utilized with machines for producing double-corrugated cardboard or triple corrugated cardboard, as well as for applying the corrugated sheet 18 to the first face sheet 22.

The machine 10 preferably includes a source 24 of the single-face corrugation assembly 14, a source 26 of the second face sheet 16, a coating station 28 for the second face sheet 16, a pre-heating station 30 for heating the corrugation assembly 14 and the second face sheet 16, a gluing station 32 for applying glue to the corrugation assembly 14, a curing station 34 for joining the corrugation assembly 14 and the second face sheet 16, and a traction station 36 for pulling the finished corrugated cardboard sheet 12 through the machine 10.

The web of the single-face corrugation assembly 14 is supplied to the machine 10 from a source 24 such as, for example, a single facing machine. The source 24 of the corrugation assembly 14 can be of any conventional type. The second face sheet 16 is supplied from a source 26 such as, for example, a supply roll.

From the source 26, the second face sheet 16 passes to the coating station 28. The coating station 28 includes a coating machine for applying a coating to one side of the second face sheet 16. The coating station 28 is not essential to the present invention and is merely illustrated as one available processing apparatus that can be incorporated into the machine 10, particularly where at least one side of the cardboard sheet 12 is to be provided with printing and/or a decorative finish.

Next, the corrugation assembly 14 and the second face sheet 16 both pass through the pre-heating station 30. The pre-heating station 30 includes a heating machine for pre-heating the corrugation assembly 14 and the second face sheet 16. The pre-heating station 30 also is optional depending upon the type of adhesive being applied to the corrugation assembly 14 to join the second face sheet 16.

From the pre-heating station 30, the single-face corrugation assembly 14 passes to the gluing station 32. The gluing station 32 includes a precision glue machine 38 in accordance with the present invention. The glue machine 38 applies an accurately controlled amount of adhesive 40 (best shown in FIG. 2B) to the crests of the flutes 20 as described in more detail hereinafter.

Next, the corrugation assembly 14 and the second face sheet 16 both pass through the curing station 34. The curing station 34 includes a "double facer" which brings the single-face corrugation assembly 14 and the second face sheet 16 together. The double facer can be of any conventional type. Once brought together, the single-face corrugation assembly 14 and the second face sheet 16 pass between guide plates 42 which maintain the assembly flat and straight as the adhesive 40 cures. Additionally, heat can be applied to the plate to aid in the curing of the adhesive.

From the curing station 34, the glued and dried cardboard sheet 12, including the two face sheets 16, 22 bonded to opposite sides of the corrugated sheet 18, passes to the traction station 36. The traction station 36 includes drive and traction rollers 44 which pull the cardboard sheet 12 from the machine 10.

Figure 3:
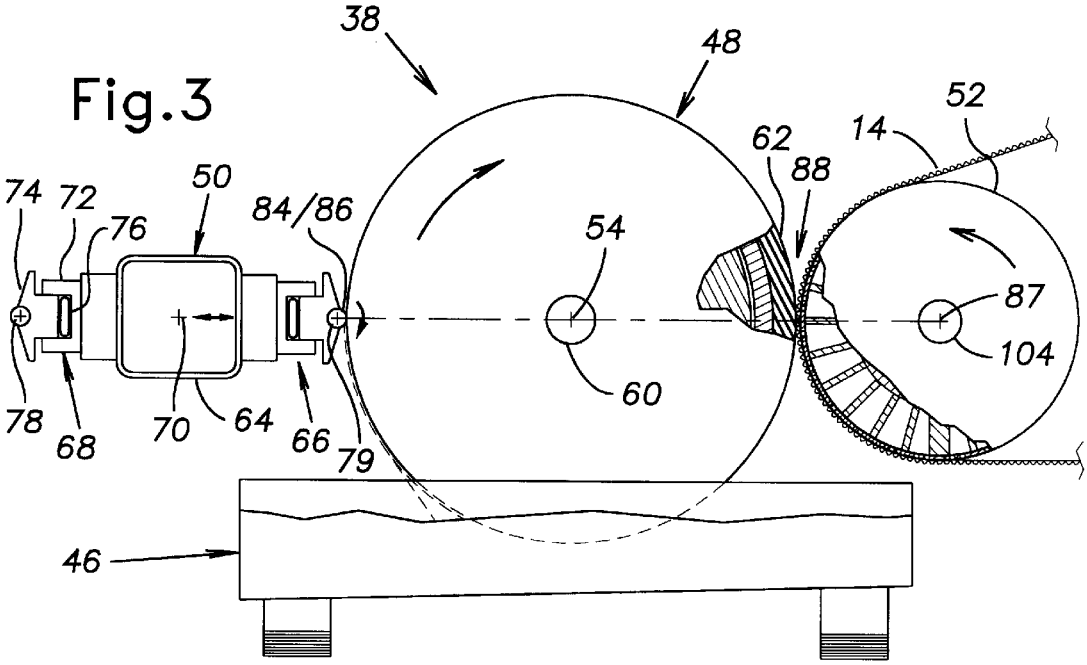
FIG. 3 is an enlarged fragmentary view, partially in cross-section, showing a portion of the machine of FIG. 1 at a glue mechanism for applying adhesive to crests of a single faced corrugation assembly.

As best shown in FIG. 3, the glue machine 38 includes a glue tray 46, a glue applicator roll 48, an isobar assembly 50, and a rider roll 52. The glue tray 46 is a container having an open top which when filled with glue provides a source or supply of adhesive. The glue tray 46 is located directly below the applicator roll 48 and extends below at least a portion of each of the isobar assembly 50 and the rider roll 52.

The applicator roll 48 is journaled for rotation about a horizontal and transverse rotational axis 54 in the direction indicated by the arrow (clockwise as viewed in FIG. 3). The applicator roll 48 is located above the glue tray 46 and positioned so the lower portion of the applicator roll 48 is immersed in the adhesive within the glue tray 46 at a coating position of the roll 48. As the applicator roll 48 rotates, a coating of adhesive is applied to the periphery of the applicator roll 48 at the coating position. As the surface of the applicator roll 48 emerges from the adhesive within the glue tray 46, a coating of adhesive exceeding the desired final coating or film thickness adheres to the outer peripheral surface of the roll 48.

Figure 4:
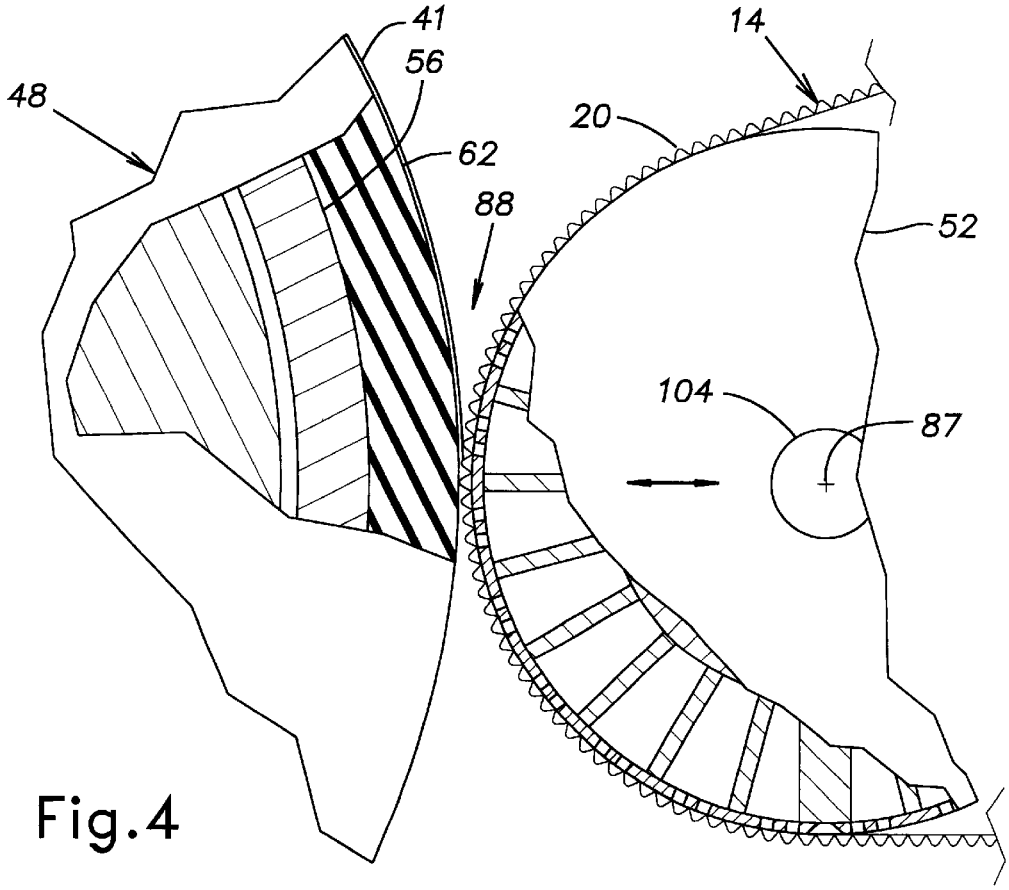
FIG. 4 is an enlarged fragmentary view, partially in cross-section, showing a portion of the glue mechanism of FIG. 3 at an interface between an applicator roll and a vacuum rider roll.
Figure 5:
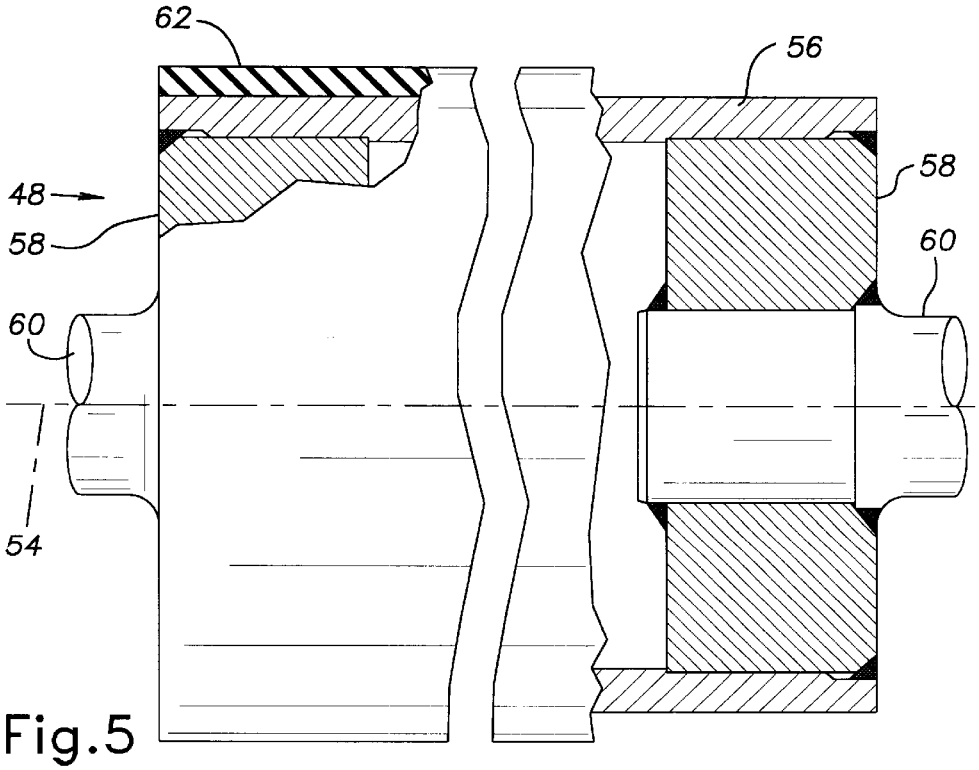
FIG. 5 is a fragmentary side view, partially in cross-section, of the applicator roll of FIGS. 3 and 4.

As best shown in FIGS. 4 and 5, the applicator roll 48 preferably has an outer shell 56, a pair of end plates 58, and a pair of support shafts 60. The outer shell 56 is cylindrically-shaped and formed from a suitable metal. The end plates 58 are secured to opposite ends of the shell 56 in any suitable manner such as, for example, by welding. The support shafts 60 are secured to the end plates 58 at the rotational axis 54 so that the end plates 58 connect the support shafts 60 to the outer shell 56. The shafts 60 are secured to the end plates 58 in any suitable manner such as, for example, by welding. A coating 62 is applied to the outer peripheral surface of the cylindrical shell 56 and provides a smooth peripheral contact surface of the applicator roll 48. The coating 62 is of any suitable material such as, for example rubber and preferably has a hardness in the range of 0 to 5 P & J hardness. The coating 62 is preferably provided with an extremely smooth surface finish.

The isobar assembly 50 is mounted adjacent to the periphery of the applicator roll 48 and removes excess adhesive from the outer peripheral surface of the applicator roll 48 to provide an adhesive coating 41 having precise uniform thickness on the outer peripheral surface of the applicator roll 48 after it has rotated past the isobar assembly 50. The most preferred thickness of the adhesive coating 41 depends on the size of the flutes to which the glue is to be applied. Table 1 below shows the most preferred adhesive coating 41 thicknesses for different size flutes. The A, B, C, and E flutes listed in table 1 refer to standard flute sizes well known in the corrugated board art by their respective letter designations. Alternatively, the adhesive coating thickness is preferably at least 0.002, 0.003, 0.004, 0.005, or 0.006, inches.

TABLE 1

Preferred thickness of adhesive coating on outer surface of applicator roll for different sized flutes

| Flute Size | Adhesive Coating Thickness (inches) |
|---|---|
| A | 0.008 or less, preferably 0.006–0.008 |
| B | 0.006 or less, preferably 0.003–0.006 |
| C | 0.006 or less, preferably 0.003–0.006 |
| E | 0.006 or less, preferably 0.003–0.006 |
| Smaller than E | 0.004 or less, preferably 0.001–0.003 |

Preferably, the isobar assembly 50 is located at the rear side of the applicator roll 48 (opposite the rider roll 52) and at the same height as the rotational axis 54 of the applicator roll 48, that is, the isobar assembly 50 is located at a 9-o'clock position relative to applicator roll 48 (as best shown in FIG. 3).

The illustrated embodiment of the isobar assembly 50 includes a frame member 64 and first and second metering rod assemblies 66, 68. The frame member 64 is relatively stiff and is mounted on the glue machine 38 for rotation about a central axis 70 over at least 180 degrees. Therefore, the frame member 64 can be rotated from the position illustrated to a position of opposite orientation. The metering rod assemblies 66, 68 are mounted on opposite sides of the frame member with the first assembly on the side facing the applicator roll 48 and the second assembly on the side facing away from the applicator roll 48. It can be seen that when the frame member 64 is rotated 180 degrees, the position of the assemblies 66, 68 is reversed; that is, with the second assembly 68 on the side facing the applicator roll 48 and the first assembly 66 on the side facing away from the applicator roll 48. Optionally, isobar assembly 50 can have additional metering rod assemblies, e.g. spaced on all four sides of the frame member 64 offset by 90-degree angles (not shown). In this embodiment, it will be understood that the frame member 64 would rotate about axis 70 in 90-degree intervals to sequentially place the respective metering rod assemblies in the operative position adjacent the applicator roll 48.

In instances where it is necessary to use two (or more) different types or thicknesses of adhesives which require different isobar structures, the first and second assemblies 66, 68 (and third, fourth, etc. if provided) are each selected to be suitable with one of the two (or several) adhesives. When the adhesive is changed, requiring a different isobar structure, the isobar assembly 50 is rotated to place the appropriate metering rod assembly in the operative position as described above.

In instances where it is not necessary to change adhesives, the additional assemblies (e.g. assembly 68 in FIG. 3) can be spare or backup assemblies. In the event that the first assembly 66 wears or becomes unsatisfactory for any reason, the isobar assembly 50 is rotated 180 degrees so that the second assembly 68 is pivoted into the operative position without delay.

The metering rod assemblies 66, 68 are substantially identical in structure, and each includes a channel member 72, a holder 74, a tubular pressure-tight bladder 76, and an isobar or metering rod 78. The channel member 72 is secured to the side of the frame member 64 and forms a longitudinally extending channel. The holder 74 has a projection on an inner side and a groove on an outer side. The projection is sized and shaped to extend into the channel so that the holder 74 is moveable toward and away from the frame member 64 within the channel member 72. The groove is sized and shaped for receiving the metering rod 78 so that the metering rod 78 is mounted in and supported by the holder 74.

The bladder 76 is positioned between the holder 74 and the channel member 72 within the channel of the member 72. Fluid pressure, preferably air pressure, is applied to the bladder 76 of the active metering rod assembly which is the assembly in the operative position adjacent the applicator roll 48 (assembly 66 in FIG. 3). The fluid pressure within the bladder 76 produces a force urging the holder 74 and the associated metering rod 78 toward the outer peripheral surface of the applicator roll 48. It should be noted that the force produced by the bladder 76 is uniform along the entire length of the metering rod 78.

It is important for the metering rod 78 to be supported such that the metering rod 78 is not deflected up or down with respect to the applicator roll 48 as a result of the hydraulic pressure; i.e. the metering rod 78 is urged toward the applicator roll 48 such that the metering rod axis 79 and the applicator roll axis 54 remain substantially coplanar in a horizontal plane during operation as shown in FIG. 3. The hydraulic pressure is a function of applicator roll speed and adhesive viscosity, among other things. The metering rod 78 and the holder 74 are sized such that they are flexible under the hydraulic forces encountered and therefore are not displaced from hydraulic pressure. Because the pressure supplied from the bladder 76 establishes a uniform force along the entire length of the metering rod, however, there is no change in spacing between the outer peripheral surface of the applicator roll 48 and the metering rod 78 along its entire length. Therefore, the metering rod 78 is positioned to produce a uniform thickness or coating of adhesive on the outer peripheral surface of the applicator roll 48 along its entire length. This is true even if the frame member 64 deflects to some degree under loading from hydraulic pressure.

In conjunction with the isobar assembly 50 as above described, it is possible to use a glue with very high solids content, preferably at least 25, more preferably 27, most preferably 30, weight percent solids, balance water, compared to other conventional glue machines that do not use an isobar assembly as described. This enables application of a very thin, uniform glue coating 41 on the surface of the applicator roll 48 that will not saturate the flutes of a corrugated sheet 18 as they come into contact with the glue layer as described in detail below.

Figure 6:
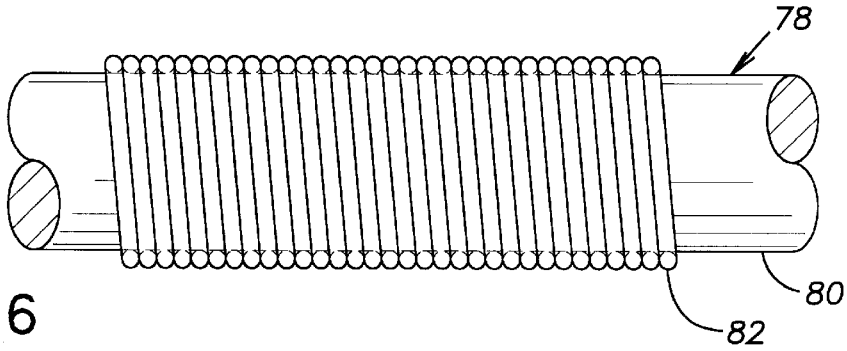
FIG. 6 is an enlarged fragmentary side view of an isobar metering device of the glue mechanism of FIG. 2.
Figure 6A:
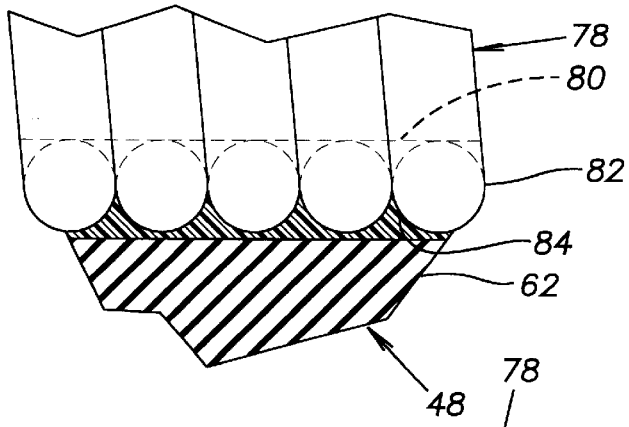
FIG. 6A is an enlarged fragmentary view at an interface between the isobar metering device and the applicator roll.

As best shown in FIGS. 6 and 6A, the isobar or metering rod 78 preferably includes a cylindrical rod 80 and spiral wound wire 82 thereon. The rod 80 extends the length of the applicator roll 48 and has a uniform diameter such as, for example about ⅝ of an inch. The wire 82 has a relatively small diameter such as, for example, of about 0.060 inches. The wire 82 is tightly spiral wound around the rod 80 in abutting contact along the length of the rod 80 to provide an outer surface, best illustrated in FIG. 6A, which forms small concave symmetrical cavities between the contact points of adjacent loops of wire 82. These small concave cavities 84 provide spaces with respect to the smooth outer surface of the applicator roll 48 so that small ridges of adhesive remain on the surface of the applicator roll 48 as the surface passes the metering rod 78.

It should be noted that even though adhesive on the outer surface of the applicator roll 48 tends to be in the form of ridges after it passes the metering rod 78, the adhesive tends to flow laterally and assume a uniform, flat and thin coating layer via cohesion. Of course, the viscosity of the adhesive in relation to the cohesion thereof determines the extent to which the adhesive coating becomes completely smooth. Preferably, the adhesive is a high-solids content adhesive as described above, having a viscosity of 15–55 Stein-Hall seconds.

The position of the isobar assembly 50 is adjustable toward and away from the applicator roll 48 to precisely set the gap therebetween (as indicated in FIG. 3). When the isobar assembly 50 is adjusted so that metering rod 78 is in virtual contact with the outer surface of the applicator roll 48, essentially all of the adhesive except that passing through the concave cavities between adjacent turnings of the wire 82, is removed from the outer surface of the applicator roll 48. On the other hand, when the metering rod 78 is spaced slightly away from the outer surface of the applicator roll 48 by reducing the pressure within the associated bladder 76, a coating of adhesive having greater thickness remains on the outer surface of the applicator roll 48. As indicated above, in a preferred embodiment the isobar assembly 50 is positioned with respect to the applicator roll 48 to provide a uniform adhesive coating on the outer surface having the preferred thickness for the desired flute size as explained above. It will be understood that the optimal position for the isobar assembly 50 will depend upon the viscosity, the solids content, and the surface tension of the adhesive being used, as well as the size of the flutes (e.g. A, B, C, E, etc.).

As best shown in FIG. 3, the metering rod 78 is mounted in and supported by the outer groove of holder 74 for rotation therein about its central axis 79. In operation, the metering rod 78 is rotated at a relatively high speed in the same direction as the rotation of the applicator roll 48 so that the metering rod 78 remains clean by throwing off excess adhesive. By rotating in the same direction as the applicator roll 48, excess adhesive is thrown in a downward direction back into the glue tray 46.

Figure 7:
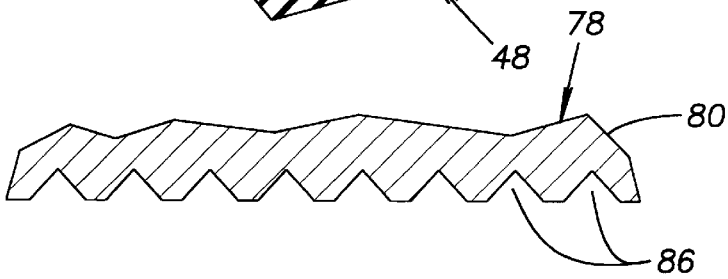
FIG. 7 is an enlarged fragmentary side view, similar to FIG. 6, of an alternative isobar metering device which may be used with the glue mechanism of FIG. 3.

As best shown in FIG. 7, the metering rod 78 can alternatively be a solid rod that has been machined to provide a grooved outer surface rather than having wire wound thereon. The machined outer surface preferably has inwardly extending cavities or grooves 86 which function similarly to the concave cavities 84 formed by the wire 82. The illustrated grooves 86 are axially spaced along the length of the metering rod 78 to provide a narrow flat section between the grooves 86. This variation of the metering rod 78 tends to remove a greater amount of adhesive and is typically used in applications where very thin coatings are required. Here again, the rod 78 is rotated to keep it from accumulating excess adhesive.

As best shown in FIG. 3, the rider roll 52 is journaled for rotation about a horizontal and transverse axis 87 in the direction opposite that of the applicator roll 48 and indicated by the arrow (counterclockwise) as viewed in FIG. 3. Preferably, the rider roll 52 is located at the forward or downstream side of the applicator roll 48 and with the axis 87 at the same height as the axis 54 of applicator roll 48; that is, the rider roll 52 is located at a 3-o'clock position relative to applicator roll 48 (as best shown in FIG. 3). As such, the metering rod 78, the applicator roll 48, and the rider roll 52 are positioned linearly with the axes 79, 54, and 87 of the metering rod 78, the applicator roll 48, and the rider roll 52 respectively substantially in the same horizontal plane (best shown in FIG. 3). Additionally, a vertically extending gap or space 88 is formed between the applicator roll 48 and the rider roll 52 for passage of the corrugation assembly 14 therethrough.

As best shown in FIG. 4, the position of the rider roll 52 is adjustable directly toward and away from the applicator roll 48 so that the width of the gap 88 can be precisely adjusted to control the degree to which the flutes 20 of the corrugation assembly 14 are compressed against the applicator roll 48 as they pass through gap 88. The degree of flute compression can be controlled to a high degree of accuracy because the rider roll 52 is linearly adjustable; that is, the rotational axis 87 of the rider roll 52 is movable directly toward and away from the rotational axis 54 of the applicator roll 48. Additionally, flexure of the rolls 48, 52 due to gravity does not affect the gap 88 because the gap 88 is vertical.

The gap 88 is preferably precisely closed and opened by a closed loop system including a motor and a linear transducer which moves the rider roll 52 toward and away from the applicator roll 48. Preferably, a pair of air cylinders can also open the gap between the rider roll 52 and the applicator roll 48 to a relatively large distance, such as about 4 inches, to meet various safety requirements.

Side to side accuracy of the precise gap, that is along the length of the rider roll 52, is maintained with two adjustment jacks and a cross-connecting shaft. The shaft transversely extends the length of the rider roll 52 and the adjustment jacks are located at or near the ends of the shaft so that the rider roll outer surface can be adjusted to be precisely parallel to the applicator roll outer surface. The cross-connecting shaft of the illustrated embodiment is a central shaft 89 of an idler roll 90 (best shown in FIG. 10) discussed in more detail below. It is noted, however, that the cross-connecting shaft could alternately be a central shaft in the rider roll 52.

Figure 4A:
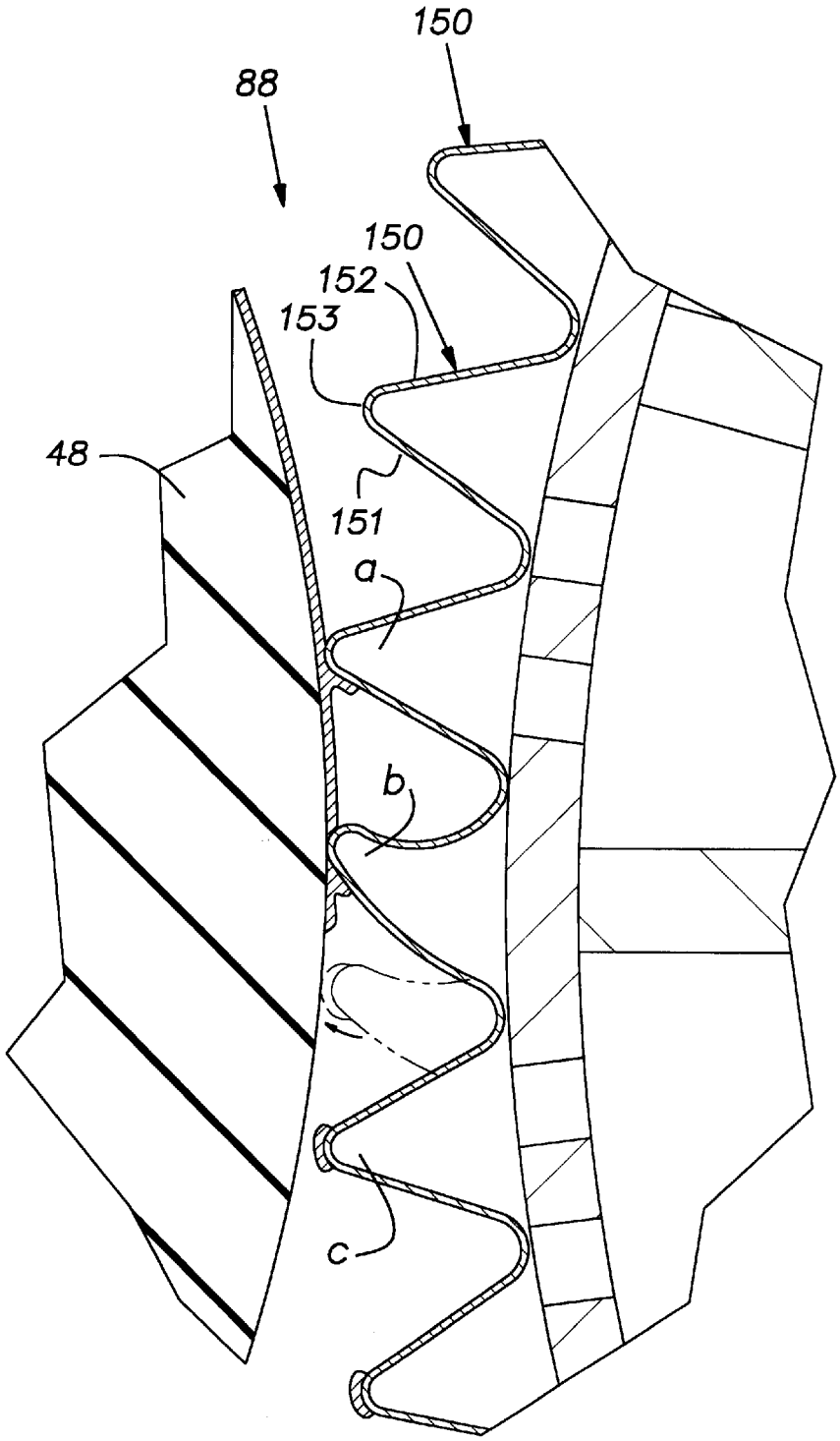
FIG. 4A is an enlarged view as in FIG. 4, showing glue being applied to the flute crests of a corrugated sheet along a path between the applicator roll and the rider roll according to a preferred method of the invention.
Figure 8:
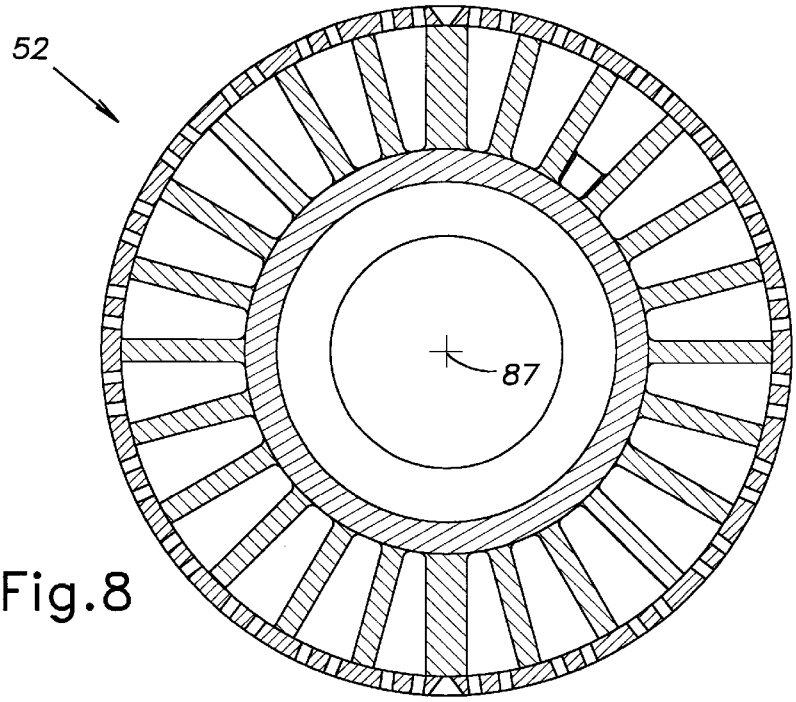
FIG. 8 is a cross-sectional end view of the vacuum rider roll of FIGS. 3 and 4.

Referring to FIG. 4A, a preferred method for applying adhesive to the crests of the flutes of a corrugated sheet 18 is shown. In this method, the position of the rider roll 52 is set to adjust the gap 88 between the rider roll 52 and the applicator roll 48 so that the flutes are compressed 3–30, preferably 5–15 or 5–10, percent of their initial flute height upon contact with the applicator roll 48. In other words, the flutes are compressed down to 70–97, preferably 85–95 or 90–95, percent of their initial flute height. As shown in FIG. 4A, a characteristic flute 150 has a leading sloped face 151, a trailing sloped face 152, and a crest 153. (Flute 150 in FIG. 4A is simply a characteristic flute 20 as it passes through the gap 88. The reference numeral 150 is used here instead of 20 merely for clarity to indicate a flute as it passes through the gap 88). In FIG. 4A, the notation a/b/c refers to the relative position of the characteristic flute 150; i.e. 150*a* refers to a position prior to contact with the applicator roll 48, 150*b* refers to a position at the nip point in contact with the applicator roll 48, and 150*c* refers to a position following contact with the applicator roll 48. This a/b/c notation is used consistently in the following description with reference to FIG. 4A. As the flute 150*a* approaches the applicator roll 48, the leading sloped face 151*a* first contacts the applicator roll 48 and has adhesive deposited thereupon. As the flute 150*a* proceeds into full contact with the applicator roll at 150*b*, the leading sloped face 151*a* proceeds to 151*b* as shown, with glue now having been applied both to the leading sloped face 151*b* and the crest 153*b*. As can be seen from the figure, no glue has been applied to the trailing sloped face 152*b* because as the flute proceeds from 150*a* to 150*b*, it is compressed to so great a degree (preferably down to 70–97% of its initial height) that the trailing sloped face 152*b* is bent backward as shown in FIG. 4A, and is therefore shielded or isolated from contact with the applicator roll 48 as shown. Thus, the trailing sloped face 152*b* does not come into contact with any glue.

As the flute proceeds from 150*b* to 150*c*, initially there is glue both on the crest 153*b* and the leading sloped face 151*b*. However, it is only desired to have glue on the crest and not the leading sloped face. Otherwise, washboarding and directional strength variations in the finished corrugated cardboard product can result as above described. To solve this problem, during operation the applicator roll is rotated at a low speed such that the surface linear velocity of the applicator roll is much lower than the velocity of the corrugated sheet 18 through the gap 88. The surface linear velocity of the applicator roll 48 refers to the linear speed of the outer surface of the applicator roll 48, measurable in feet per minute. The surface linear velocity is related to the angular velocity (i.e. rotations per minute or RPMs) by the relation $v=2\pi r\Omega$; where v is the surface linear velocity in feet/min, r is the radius of the applicator roll 48 in feet, and $\Omega$ is the angular velocity of the applicator roll 48 in RPMs. Preferably, the outer surface linear velocity of the applicator roll 48 is less than 95% that of the corrugated sheet, more preferably less than 90, preferably 80, preferably 60, preferably 50, preferably 45, and most preferably 40, percent that of the corrugated sheet 18. The above ratio of applicator roll 48 speed to corrugated sheet 18 is referred to as the roll speed ratio.

By operating at low roll speed ratios, as the flute emerges from contact with the applicator roll 48 (shown in phantom in FIG. 4A) to proceed from 150*b* to 150*c*, glue from the leading sloped face 151*b* is actually dragged backward by cohesive forces in a direction toward the crest 153*b* as shown by the (phantom) arrow in FIG. 4A. Thus, at 150*c*, there is substantially no glue remaining on the leading sloped face 151*c* and all of the glue has been piled onto the crest 153*c*. And because no glue is deposited to the trailing sloped face at 152*b*, none is present at 152*c*. The result is a flute at 150*c* following application of the adhesive that has glue only on the crest 153*c*, and none on either the leading or trailing sloped faces 151*c* or 152*c*.

Furthermore, when operating at the most preferred roll speed ratios, (less than 45%, preferably less than 40%), each subsequent flute passes over at least a portion of the preceding flute's path against the roll 48. The result is that the applicator roll 48 is wiped substantially clean of all of the glue thereon. This in turn results in a substantially linear relationship between roll speed and glue weight applied to the flute tips, with the glue weight being substantially uniform among the flute tips. This means that the amount of glue applied to the flute tips is reliably and reproducibly controlled as a function of roll speed. Much above the most preferred speed ratio, for example at roll speed ratios higher than about 45 or 50 percent, the applicator roll 48 rotates too quickly to be wiped clean as described above, and some glue will tend to be dragged onto some of the flutes as they emerge from the gap 88 due to cohesive forces, glue surface tension effects, and glue absorbency in the flute material. In that event, the applied glue weight will vary unpredictably and uncontrollably from flute to flute.

In particular, it has been found that an adhesive coating 41 thickness on the outer surface of applicator roll 48 less than about 0.006 inches, and a roll speed ratio less than about 40%, result in the flutes coming into contact with the roll 48 being able to accept more glue that is present on the roll 48, and the entire surface of the roll 48 being substantially wiped clean. Under these conditions, excellent glue weight control and reproducibility is achieved.

Following contact with the applicator roll 48, the flute 150*c* rebounds to substantially its initial dimensions (height) prior to being compressed at 150*b*. Preferably, the flute 150*c* rebounds to at least 80, preferably at least 85, preferably at least 90, preferably at least 95, preferably at least 96, preferably at least 98, percent of its initial height. Near complete rebound is possible in the present invention because of the very thin, high-solids content adhesive coating 41 on the outer surface of applicator roll 48. Such a coating is achieved via the isobar assembly 50 as described above, and results in the flutes not becoming saturated with or absorbing a significant amount of water as they come into contact with the adhesive coating 41 on the surface of applicator roll 48. In conventional machines, flute height compression to the extent described and preferred herein is not possible because the flutes would absorb so much water from the deeper, waterier glue coating characteristic of conventional gluing methods as to prevent satisfactory rebounding of the flutes. The described degree of flute compression prevents glue from being dragged from the crest 153*b* onto the trailing sloped face 153*b*,153*c* as a result of the slow applicator roll speed. Hence, the above-described degree of flute height compression allows the applicator roll 48 to be operated at significantly lower surface linear velocities than were possible in the prior art without resulting in glue being dragged onto the trailing sloped face 152. Hence, the present method allows accurate application of glue from an applicator roll 48 to only the crests 153 of the flutes of a corrugated sheet 18, with no or substantially no glue being applied to the leading or trailing sloped faces 151 or 152 thereof.

The combination of a glue machine 38 as described above having an isobar assembly 50, and the described method of applying glue only to the crests of the flutes of a corrugated sheet 18, provides precise control of glue weight over a wide range while ensuring proper placement only on the flute crests. The adhesive has an even thickness and is symmetric about the crest 153*c* of the flute 150*c* with sharply defined edges resulting in both a reduction in the amount of adhesive used and a maximum bonding strength.

The result is a finished corrugated cardboard product having superior surface appearance with substantially no washboarding, and superior and uniform impact and crush strength independent of direction.

The size of the rider roll 52 is preferably minimized to as small as practically possible. The minimized size of the rider roll 52 reduces the number of the flutes 20 of the corrugation assembly 14 that are in contact with the adhesive coating at one time, and thus reduces the dwell time in which the flutes 20 are in contact with the adhesive coating as discussed below in more detail.

Figure 9:
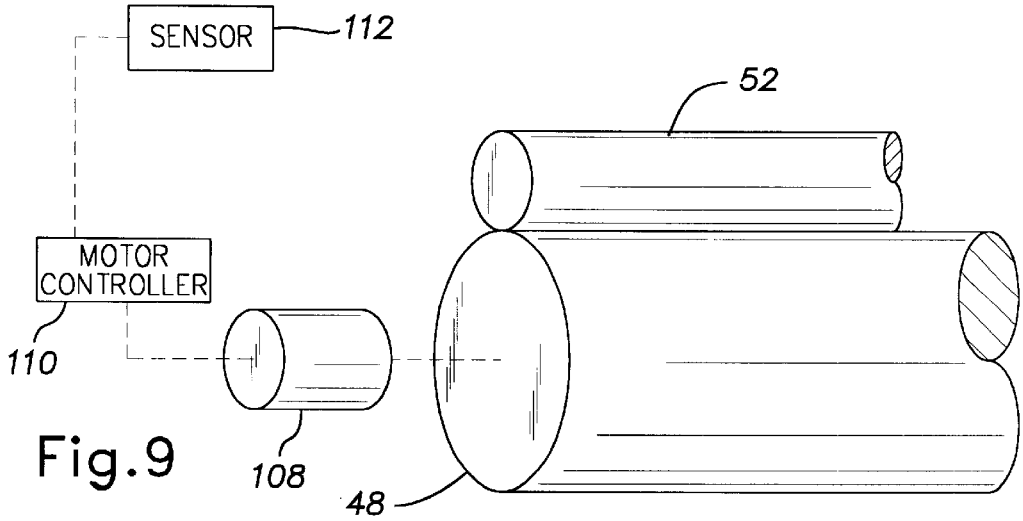
FIG. 9 is a schematic view of a drive system for driving the applicator roll and for controlling the speed thereof.

FIG. 9 schematically illustrates a drive system for the applicator roll 48. A variable speed motor 108 is connected to the applicator roll 48 and provides power to rotate the applicator roll 48 during the operation of the machine 10. An electronic control 110 is connected to the motor 108 and adjustably controls the rotational speed of the applicator roll 48. This ability to control the speed of the roll 48 is an important feature of the present invention because it allows adjustment of the applicator roll surface linear velocity relative to the velocity of the corrugation assembly 14 (and therefore corrugated sheet 18) as described above. This provides the very precise control of the transfer of adhesive from the applicator roll 48 to the flutes 20 of the corrugation assembly 14.

Because the gap 88 between the applicator roll 48 and the rider roll 52 is vertical, gravity pulls straight down on the glue layer at the nip point of the gap 88 so that the amount of glue applied is directly proportional to the rotational speed of the applicator roll 48. Therefore, changes in glue coating 41 thickness on the applicator roll 48 are no longer necessary for controlling the amount of glue applied to the corrugation assembly 14 or coating weight control. The coating weight can be automatically controlled by connecting a glue weight sensor 112 to the motor controller 110 so that the controller 110 automatically adjusts the speed of the applicator roll 48 until the weight detected by the sensor 112 is equal to a desired amount. Furthermore, by using a high-solids content glue and compressing the flutes 3–30 (preferably 5–15) percent of their initial height as above-described, it is now possible to adjust the applicator roll 48 speed across a far greater range than was previously possible while still providing glue only on the crests of the flutes 20.

It is noted that as the speed of the applicator roller 48 is reduced relative to the rider roll 52, the amount of glue applied to the corrugation assembly 14 (flute crests) is reduced. A large difference in speed between the surface linear velocity of the applicator roll 48 and the velocity of the corrugated sheet 18 enables the flutes 20 to receive a more controlled and smaller amount of adhesive and enables the flutes 20 to remove virtually all of the adhesive from the applicator roll 48 to reduce over spray.

Figure 10:
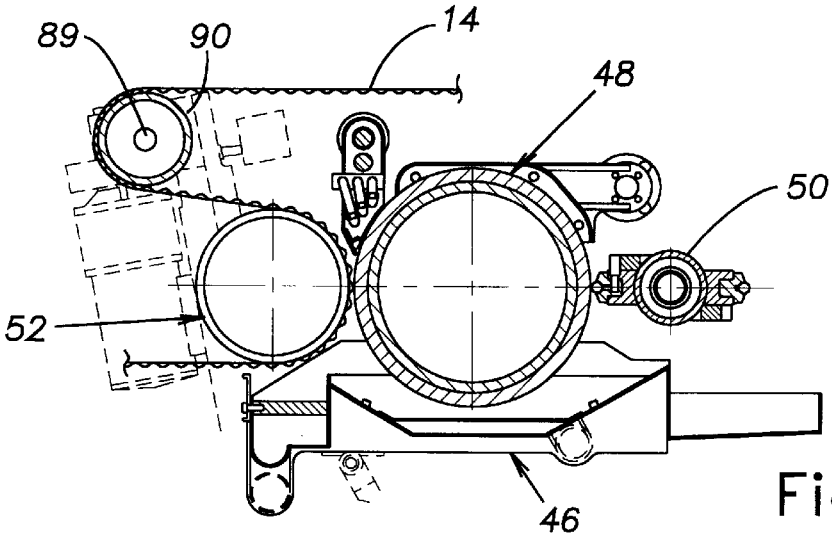
FIG. 10 is a fragmentary elevational view, partially in cross-section, similar to FIG. 2 but viewed from the opposite side and showing additional features of a rider system of the glue mechanism.

As best shown in FIG. 10, the idler roll 90 is arranged so that the corrugation assembly 14 is substantially tightly wrapped around the circumference of the rider roll 52, particularly, in the area of the gap 88 between the applicator roll 48 and the rider roll 52. Such an arrangement reduces the number of flutes 20 in contact with the adhesive layer and thus the dwell time during which the flutes 20 of the corrugation assembly 14 are in contact with the adhesive layer as discussed in more detail below. The corrugation assembly 14 preferably wraps around at least 30 percent of the periphery of the rider roll 52, and more preferably wraps around about 50 percent, that is about 180 degrees, of the periphery of the rider roll 52. In the illustrated embodiment, the idler roll 90 is positioned on the forward side of the rider roll 52 so that the corrugation assembly moves in a generally S-shaped pathway around the idler roll 90 and the rider roll 52.

The idler roll 90 is preferably carried by an arm assembly that moves the rider roll 52 so that the idler roll 90 and rider roll 52 are rigidly connected together. As a result, the idler roll 90 moves with rider roll 52 as the rider roll 52 is moved to adjust the precisely controlled gap 88. Therefore, there is no change in the length of the web path if the width of gap 88 is changed or the position of the glue machine 38 is moved.

Figure 11:
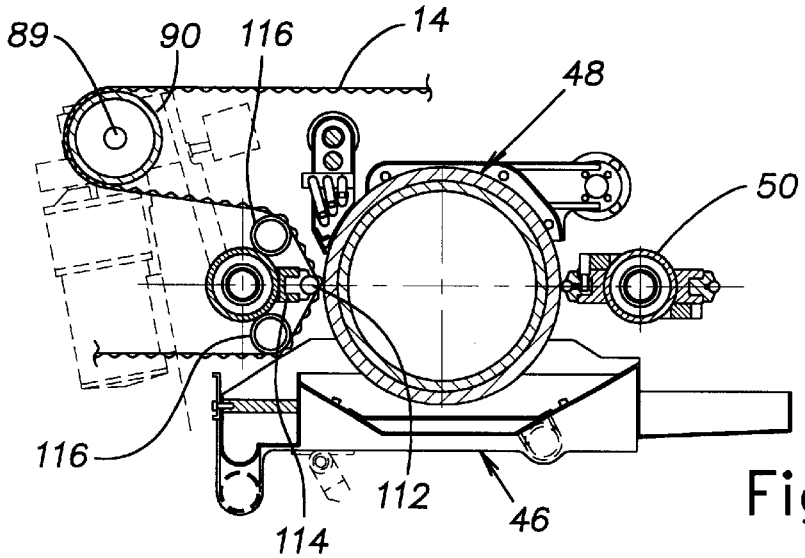
FIG. 11 is a fragmentary elevational view, partially in cross-section, similar to FIG. 10 but showing an alternative embodiment of the rider system.
Figure 12:
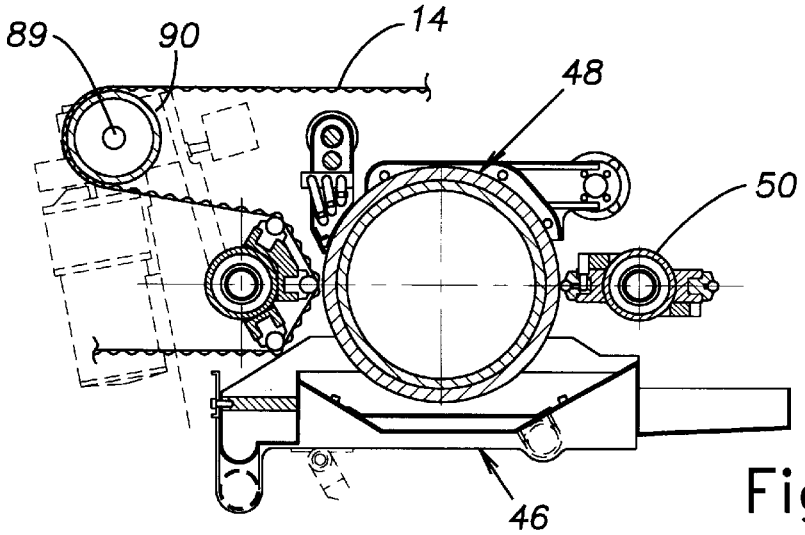
FIG. 12 is a fragmentary elevational view, partially in cross-section, similar to FIGS. 10 and 11 but showing another alternative embodiment of the rider system.

As best shown in FIGS. 11 and 12, alternate embodiments of the rider system can be utilized within the scope of the present invention to even further reduce the number of flutes 20 in contact with the glue layer and thus the dwell time. As shown in FIG. 11, the rider system can be a relatively small diameter rod 112 supported by a rod holder 114. The rod holder 114 can have a structure similar to the metering rod assemblies described above in detail. The rod 112 is preferably positioned between a pair of idler rolls 116 arranged to direct the corrugation assembly 14 to and from the rod 112. The rod 112 is an extremely small sized rider roll which operates as described in detail hereinabove with regard to the rider roll 52 of the first embodiment. The rod 112, however, provides an extremely small diameter compared to typical rider rolls. The rod 112 can have a diameter of less than 3 inches, for example 1.5 inches.

As shown in FIG. 12, the rider system can alternatively include three of the relatively small rods 112 supported by three of the rod holders 114. The two additional rods 112 function as and replace the idler rolls 116 discussed above with regard to the embodiment of FIG. 11.

During operation of the glue machine 10, the applicator roll 48 rotates and picks-up adhesive from the glue pan 46 onto the smooth peripheral outer surface of the applicator roll 48. As the adhesive rotates past the isobar assembly 50, the metering rod 78 removes excess adhesive from the outer surface of the applicator roll 48 and leaves a precisely controlled extremely thin layer of adhesive coating 41 on the outer surface of the applicator roll 48. As the applicator roll 48 continues to rotate, the precisely controlled adhesive coating 41 travels from the isobar assembly 50 to a position adjacent the gap 88; that is, the location where the flutes 20 of the corrugation assembly engage the applicator roll 48 as previously described.

The rider roll 52 rotates in a direction opposite the applicator roll 48. The first face sheet 22 smoothly engages the outer surface of the rider roll 52 and is held substantially against slippage relative thereto.

As the flutes 20 of the corrugation assembly 14 pass through the nip point of the precisely controlled vertical gap 88 between the applicator roll 48 and the rider roll 52, the flutes come into contact with the thin coating 41 of adhesive and/or the applicator roll 48 as described above.

Because the corrugation assembly 14 is substantially wrapped around the rider roll 52 and/or the size of the rider system is minimized, the flutes 20 contact the adhesive coating 41 and/or the applicator roll 52 only at the nip point of the gap 88 so that they are wetted with adhesive and compressed at essentially the same time. Preferably, only 1 to 2 flutes 20 are in contact with the adhesive and/or the applicator roll 48 at any given time. No presoaking or post soaking of the flutes 20 occurs; that is, the flutes 20 do not touch the adhesive before reaching the nip point or after leaving the nip point. Therefore the dwell time, the time for which the flutes 20 are in contact with the adhesive and/or the applicator roll 48, is minimized so that the flutes 20 remain as resilient as possible.

As the flutes 20 pass through the nip point of the vertical gap 88, the thin coating 41 of adhesive on the applicator roll 48 is transferred to the crests of the flutes 20. Any spray of adhesive generated at the nip point is downwardly directed without a horizontal velocity component. Therefore, no adhesive is sprayed outside the glue tray 46, which is located directly below the nip point, even at high speeds. Additionally, gravity eliminates any pooling problems of the adhesive because gravity pulls the adhesive straight down at the nip point.

The combination of a) metering a very thin layer of adhesive on the applicator roll 48, b) maintaining a precise and adjustable vertical gap 88 between the applicator roll 48 and the rider roll 52, c) eliminating pre-nip and post-nip soaking of the flutes 20 in the thin layer of adhesive, and d) compressing the flutes 3–30 (most preferably 5–15) percent of their initial height at the nip point, allows the surface linear velocity of the applicator roll 48 to be less than 40% of the web speed with no discernable snow plow effects, and without applying glue to the leading or trailing sloped faces of the flutes 20. Additionally, the amount of glue consumed is dramatically reduced because of minimized spray and stringing of the adhesive. Furthermore, the glue is precisely positioned on the tip of the flutes so that the final product has a maximum caliper and an extremely smooth outer surface finish.

With the present invention it is possible to efficiently apply virtually any type of hot or cold adhesive and obtain maximum strength in the finished product while applying substantially less adhesive per unit of area of the finished product.

Although particular embodiments of the invention have been described in detail, it will be understood that the invention is not limited correspondingly in scope, but includes all changes and modifications coming within the spirit and terms of the claims appended hereto.

What is claimed is:

1. A method of applying adhesive to flutes of a corrugated sheet, each said flute having a leading sloped face, a trailing sloped face and a crest, said method comprising the steps of:

a) applying a layer of adhesive on an outer surface of an applicator roll and rotating said applicator roll in a first direction;

b) moving said corrugated sheet along a path adjacent said outer surface of said applicator roll to apply adhesive to said flutes from said layer of adhesive; and c) compressing said flutes down to 70–97% of their initial height against said applicator roll;

wherein said applicator roll has a surface linear velocity less than 95% the speed at which said corrugated sheet is moving.

2. A method according to claim 1, wherein said flutes are compressed down to 85–95% of their initial height.

3. A method according to claim 1, wherein said flutes are compressed down to 90–95% of their initial height.

4. A method according to claim 1, wherein said flutes rebound to at least 95% of their initial height following compression thereof.

5. A method according to claim 1, wherein said flutes rebound to at least 98% of their initial height following compression thereof.

6. A method according to claim 1, further comprising the steps of:

d) initially contacting each said flute with said applicator roll along said leading sloped face of said flute, thereby depositing glue on said leading sloped face;

e) compressing said flute such that said trailing sloped face is bent backward and shielded from contact with said applicator roll; and f) contacting said crest of said flute with said applicator roll thereby depositing glue on said crest.

7. A method according to claim 6, wherein said applicator roll has a surface linear velocity lower than a velocity of said corrugated sheet such that, following step (f), said glue on said leading sloped face of said flute is dragged backward and piled onto said crest thereof.

8. A method according to claim 1, further comprising the steps of:

d) rotating a rider roll in a second direction opposite said first direction of said applicator roll, said rider roll and said applicator roll each having a rotational axis, each of said rotational axes being substantially parallel to one another;

e) positioning said rider roll in a position adjacent said applicator roll to provide a gap therebetween, said path of said corrugated sheet proceeding through said gap; and f) adjusting said position of said rider roll relative to said applicator roll to set a width of said gap and thereby to regulate a degree of compression of said flutes against said applicator roll.

9. A method according to claim 8, wherein said gap width is adjusted so that said flutes are compressed down to 70–97% of their initial height against said applicator roll.

10. A method according to claim 8, wherein said gap width is adjusted so that said flutes are compressed down to 85–95% of their initial height against said applicator roll.

11. A method according to claim 8, wherein said rotational axes of said applicator roll and said rider roll are substantially coplanar in plane.

12. A method according to claim 1, wherein said surface linear velocity of said applicator roll is less than 50% the speed of said corrugated sheet.

13. A method according to claim 1, wherein said surface linear velocity of said applicator roll is less than 45% the speed of said corrugated sheet.

14. A method according to claim 1, wherein said surface linear velocity of said applicator roll is less than 40% the speed of said corrugated sheet.

15. A method according to claim 1, wherein said adhesive is at least 25 weight percent solids, balance water.

16. A method according to claim 1, wherein said adhesive is at least 27 weight percent solids, balance water.

17. A method according to claim 1, wherein said adhesive is at least 30 weight percent solids, balance water.

18. A method according to claim 1, wherein said adhesive is at least 30 weight percent solids, balance water, and said adhesive layer has a thickness of 0.002 inches.

19. A method according to claim 1, wherein said adhesive is at least 30 weight percent solids, balance water, and said adhesive layer has a thickness of 0.003 inches.

20. A method according to claim 1, wherein said adhesive is at least 30 weight percent solids, balance water, and said adhesive layer has a thickness of 0.004 inches.

21. A method according to claim 1, wherein said adhesive is at least 30 weight percent solids, balance water, and said adhesive layer has a thickness of 0.005 inches.

22. A method according to claim 1, wherein said adhesive is at least 30 weight percent solids, balance water, and said adhesive layer has a thickness of 0.006 inches.

23. A method according to claim 1, wherein said adhesive coating on said applicator roll has a thickness of 0.008 inches or less.

24. A method according to claim 1, said adhesive coating having a thickness of 0.006 inches or less.

25. A method according to claim 1, wherein said adhesive coating on said applicator roll is a uniform adhesive coating provided by a metering rod held in position against said applicator roll outer surface at a position subsequent to a coating position of said applicator roll, said metering rod removing excess glue from said outer surface of said applicator roll to provide said uniform adhesive coating.

26. A method according to claim 25, wherein said metering rod is adjusted by an isobar assembly to provide a desired thickness of said adhesive coating on said outer surface of said applicator roll, said isobar assembly comprising a metering rod assembly for holding said metering rod, said metering rod assembly including a channel member, a holder, and a tubular pressure-tight bladder therebetween, said channel member forming a longitudinally extending channel, said holder extending into said channel and being moveable toward and away from said applicator roll within said channel member, said holder having a groove therein for retaining said metering rod therein.

27. A method according to claim 26, wherein said metering rod assembly is adjusted by adjusting a fluid pressure within said bladder to produce a force for urging said holder and said metering rod toward said outer surface of said applicator roll.

28. A method according to claim 1, said adhesive having a viscosity of 15–55 Stein-Hall seconds.

29. A method according to claim 1, wherein only 1–2 of said flutes are in contact with said applicator roll and/or said adhesive layer at one time.

30. A method of applying adhesive to flutes of a corrugated sheet, each said flute having a leading sloped face, a trailing sloped face and a crest therebetween, said method comprising the steps of:

a) applying a layer of adhesive on an outer surface of an applicator roll and rotating said applicator roll in a first direction;

b) moving said corrugated sheet along a path adjacent said outer surface of said applicator roll to apply adhesive to said flutes from said layer of adhesive; and c) initially contacting said flute with said applicator roll along said leading sloped face of said flute, thereby depositing glue on said leading sloped face;

d) compressing said flutes down to 70–97% of their initial height against said applicator roll such that said trailing sloped face of each said flute is bent backward and shielded from contact with said applicator roll; and e) contacting said crest of said flute with said applicator roll thereby depositing glue on said crest.

31. A method according to claim 30, wherein said applicator roll has a surface linear velocity lower than a speed of said corrugated sheet such that, following step (e), said glue on said leading sloped face of said flute is dragged backward and piled onto said crest thereof as said flute emerges from contact with said applicator roll.

32. A method according to claim 31, wherein said surface linear velocity of said applicator roll is less than 95% the speed of said corrugated sheet.

33. A method according to claim 32, said surface linear velocity being less than 45% the speed of said corrugated sheet.

34. A method according to claim 30, wherein each said flute rebounds to at least 98% of its initial height.

35. A method according to claim 30, said adhesive having a viscosity of 15–55 Stein-Hall seconds.

36. A method according to claim 30, wherein only 1–2 of said flutes are in contact. with said applicator roll and/or said adhesive layer at one time.

* * * * *